US007455258B2

(12) United States Patent
Proebstle

(10) Patent No.: US 7,455,258 B2
(45) Date of Patent: Nov. 25, 2008

(54) LINE WINDING HOLDER

(76) Inventor: Jack Proebstle, 7043 Park View La., Eden Prairie, MN (US) 55346

( * ) Notice: Subject to any disclaimer, the term of this patent is extended or adjusted under 35 U.S.C. 154(b) by 341 days.

(21) Appl. No.: 11/307,628

(22) Filed: Feb. 15, 2006

(65) Prior Publication Data

US 2007/0187544 A1 Aug. 16, 2007

(51) Int. Cl.
*B65H 75/38* (2006.01)

(52) U.S. Cl. ..... 242/404.3; 242/400.1; 242/405.1

(58) Field of Classification Search ..... 242/400.1, 242/402, 404.3, 405, 405.1, 406
See application file for complete search history.

(56) References Cited

U.S. PATENT DOCUMENTS 3,926,383 A * 12/1975 McConnell ..... 242/405.1
4,123,012 A 10/1978 Hough ..... 242/85.1
4,277,035 A * 7/1981 Gaski ..... 242/404.3
5,348,240 A * 9/1994 Carmo et al. ..... 242/401
5,513,816 A * 5/1996 Grubb ..... 242/398
5,979,816 A * 11/1999 Blankenship et al. .... 242/400.1
7,048,222 B1 * 5/2006 Curtiss ..... 242/405.1

* cited by examiner

*Primary Examiner*—Sang Kim

(57) ABSTRACT

A floatable, portable rope or extension cord holder for paying out, taking up and storing rope, line or power cord and especially suited for water ski rope. The device comprises an elongated hollow tubular base and two hollow tubular rotatable winding arms attached to the base at either end by a coupling assembly. The tubular shape of the base allows for the use of clips for releasable attachment to a structure such as a garage wall or boat deck. To load and store line, rotate winding arms to the closed position and wrap using a figure-8 cross-over pattern making a safe, neat, tangle free and compact storage. To release and remove line, rotate one arm to the open position removing from one wrap to all wraps in a single movement. Whether tossed or pulled the entire length of rope or cord stored in the figure-8 pattern will uncoil tangle free.

1 Claim, 4 Drawing Sheets

LINE WINDING HOLDER

BACKGROUND OF THE INVENTION

1. Field of the Invention

The present invention relates generally to devices for winding and storage of ropes, electrical cords, and similar long, thin, flexible material. More particularly, it relates to a device for winding, storing, and dispensing of various types of lines including rope and electrical cord, which prevents tangling and twisting of various loops of the cord upon release from the storage device.

2. Description of the Prior Art

The line winding and holder devices in the patent literature generally fall into one of three basic categories: stationary types with rotatable drum, reel or spool; portable types with fixed frame; or portable types with fast line release. The present preferred embodiment is a portable device and thereby improves on the stationary and mechanically complex reel type devices as represented by patents issued to Sklenar, U.S. Pat. No. 3,028,829 and Pickrell, U.S. Pat. No. 3,813,055.

The present preferred embodiment is a fast line release device and not restricted to loop by loop unwinding necessary with the mechanically simple fixed frame type devices as represented by patents issued to Hough, U.S. Pat. No. 4,123,012, Gaski U.S. Pat. No. 4,277,035, and Carmo et al U.S. Pat. No. 5,348,240.

The present preferred embodiment is a portable device with fast line release constructed of corrosion resistant and electrically non-conductive materials, operable while attached to a structure or hand-held, with tangle free line pay-out, unobstructed line winding and release, floatable, and fail-safe release of stored line from the open position. One or more of the present preferred embodiment functions will not be found in the prior art for portable fast line release devices as represented by patents issued to Turner, U.S. Pat. No. 2,423,533, Taylor, U.S. Pat. No. 3,096,040, Jensen, U.S. Pat. No. 3,290,453, Kuncz, U.S. Pat. No. 3,901,458, Brown, U.S. Pat. No. 4,586,675, Deweese, U.S. Pat. No. 4,687,154, and Doyle, U.S. Pat. No. 4,934,646.

SUMMARY OF THE INVENTION

This invention was developed to remedy the hazardous and unsafe conditions which often result from the clutter of ropes and cords left tangled and twisted in walking and work areas and on boat decks. This invention is a preferred embodiment for winding, storing and paying out of lines, is operational from a hand-held or mounted position, and permits a rapid, tangle free deployment of from one coil to all of the stored line. The present preferred embodiment is a simple, portable, line winding, fast-release, tangle free line deployment device and a safe, compact storage unit. The present invention is light weight and a convenient device for rapidly recovering or deploying line. This device employs two rotatable arms attached by sealed couplings to a rigid base. The preferred embodiment floats preventing loss overboard from boats, and is functionally unaffected by wet environments making this device ideally useful for waterski rope winding, storage and tangle free fast-release of line. More particularly, in addition to its unique design and simplified operation, the characteristics and functions found exclusively in the present preferred embodiment include construction from corrosion resistant and electrically non-conductive materials, a sealed rotatable coupling assembly for fast line release, and floatability.

DETAILED DESCRIPTION OF THE DRAWINGS

Figure 1:
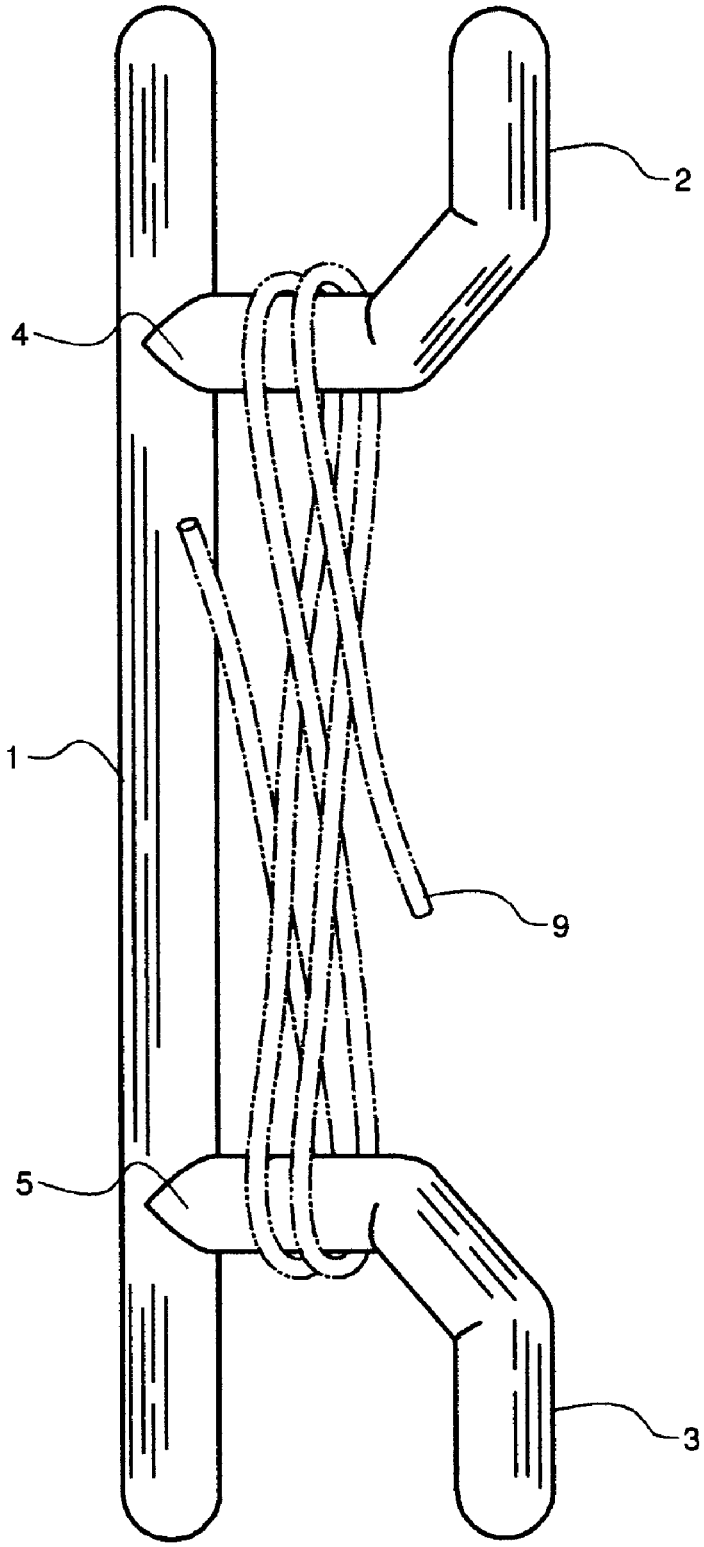
FIG. 1 is a perspective view of the line winding holder of the present invention displayed in the closed/winding/storage position with line wound in the tangle free figure 8 crossover pattern.

As shown in FIG. 1 this invention comprises a rigid elongated hollow tubular base 1 enclosed at the ends and two rigid arcuate hollow tubular rotatable winding arms 2, 3 enclosed at the outer ends and attached to rigid hollow tubular extensions 4, 5. FIG. 1 shows the line winding holder in the closed/winding/storage position such that the outer ends of the winding arms 2, 3 align approximately with the ends of the base 1 creating opposed U shaped cavities. The base 1 functions as the carrying handle, winding handle and for attachment of the line winding holder to permanent structures with off-the-shelf clips (not shown). Line may be wound onto this device while hand-held or while mounted to a structure. To wind line, move the winding arms 2 and 3 to the closed position shown in FIG. 1. Secure one end of the rope, electrical cord or line to the base or either winding arm. If hand-held, user holds the base with one hand near the center between the winding arms with the winding arms extended slightly outward from the user. A figure 8 cross-over pattern wrap of line 9 is necessary for tangle free line at release. Single loop wraps that have not been crossed-over may not result in a tangle free release of the line. Although two figure-8 wraps of line 9 are depicted in FIG. 1 it should be evident that the design permits of many more wraps. Secure line for storage by transversely wrapping or tying off the outer or bitter line end to the bundle of loops.

Figure 2:
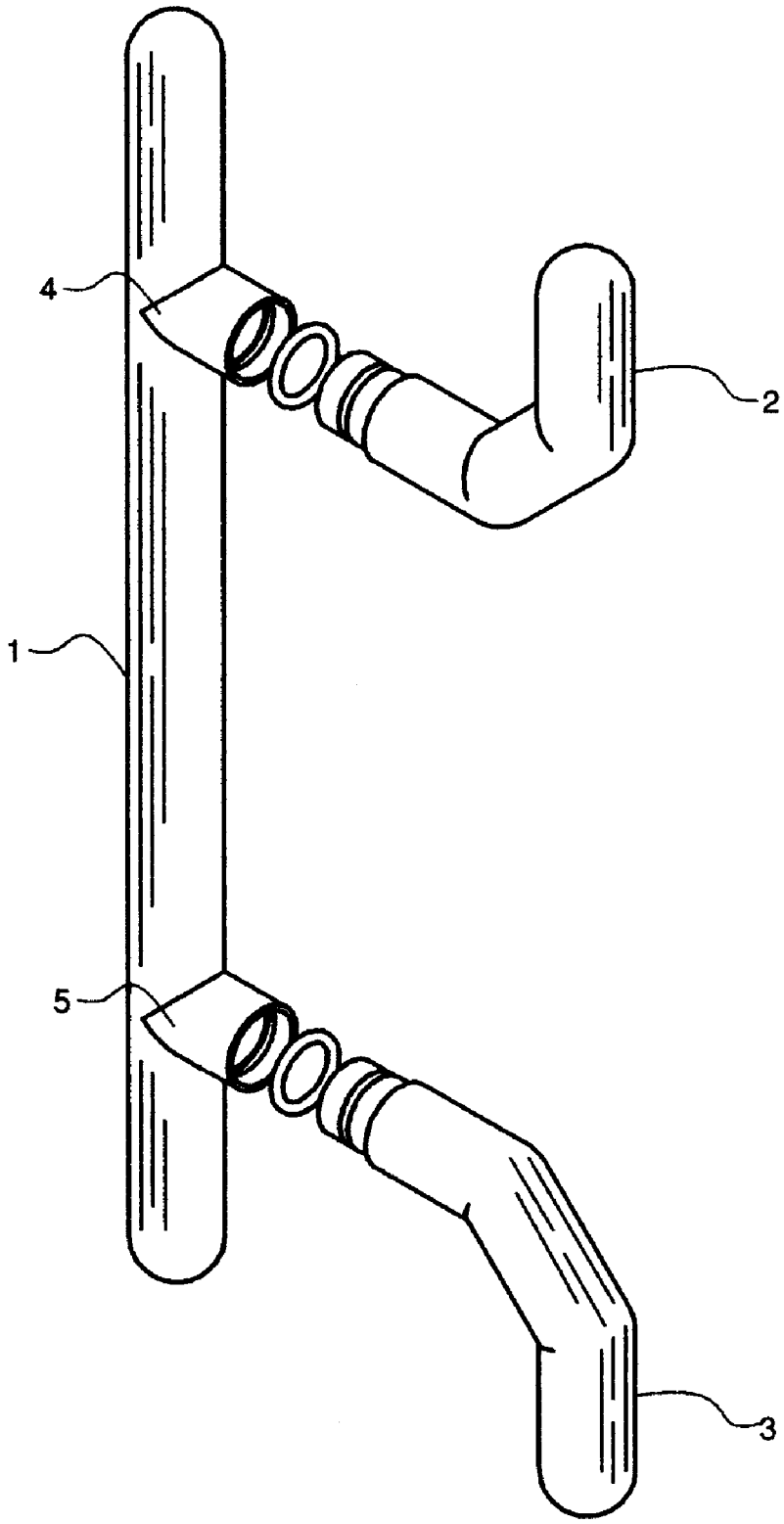
FIG. 2 is an exploded view of the line winding holder of FIG. 1 showing the elements preassembled.

FIG. 2 shows the preassembly positions of extensions 4, 5 and winding arms 2, 3 wherein the extensions and arms are aligned on the same side or face of base 1.

Figure 3:
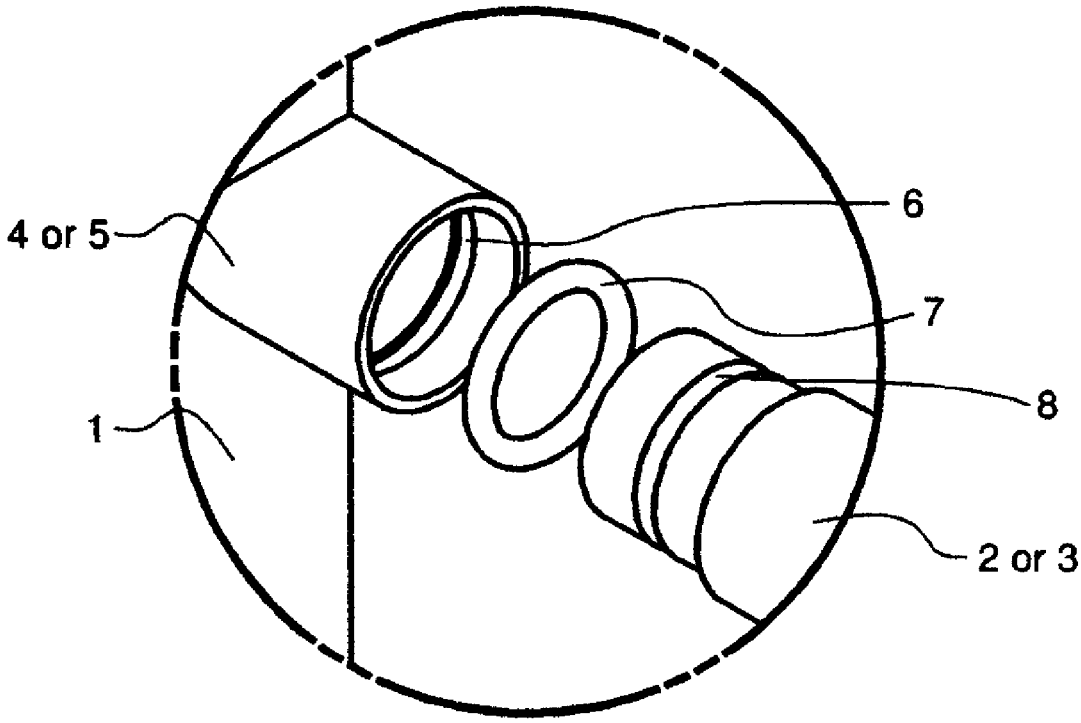
FIG. 3 is an enlarged exploded view of the coupling assembly of FIG. 2 comprised of the perpendicular extension from the base with extension groove, O-ring, and winding arm with winding arm groove.

FIG. 3 depicts an exploded view of FIG. 2 at the coupling point of extension 4 to winding arm 2 and extension 5 to winding arm 3. The coupling assembly is comprised of a silicone greased O-ring 7, extension groove 6 and winding arm groove 8. The inside diameter of the base extensions 4 and 5 are sized slightly larger than the outside diameter of the winding arm tubes to permit the winding arm to slide into the extension while maintaining surface contact between the coupled tubes. Groove 6 is cut or molded into the inner wall of base extensions 4 and 5 at the mid-point of the length of the extension to a depth slightly less than the radius of the O-ring 7 and to a width slightly greater than the diameter of the O-ring. Groove 8 is cut or molded in a similar manner and with similar dimensions to the outside surface of winding arms 2 and 3 at a distance from the winding arm coupling end to permit alignment with the extension groove 6 when assembled. The coupling assembly design employs the use of an O-ring 7 as a seal against liquid intrusion, as a retention ring to prevent separation of the coupled pieces, and to produce friction between the extension and winding arm surfaces to prevent accidental rotation of the winding arm. Assembly is performed by attaching a slightly undersized O-ring 7 to groove 8 of the winding arm. Silicone grease is applied to the O-ring and base extension for ease of assembly, to permit rotation of the winding arm and to act as a sealant against liquid intrusion. The winding arms are attached to the base extensions by gently forcing the parts together until the grooves are aligned and the winding arms are locked in place by the compressed O-rings. The wall thickness of hollow tubular base 1, base extensions 4 and 5 and winding arms 2 and 3 are of sufficient thickness to permit grooves to be cut or molded for O-rings without compromising the strength and structural integrity of the device. Alternatively, this coupling arrangement may be reversed such that the inside diameter of the winding arm is larger than the outside diameter of the tubular base extension. This reversed configuration of the coupling requires a groove on the inner wall of the winding arm and an outside groove on the extension. Another coupling method herein referenced requires a seal in the area where the extension is attached to the base and a seal near the coupling end of the winding arm. As before, the winding arms are attached to the base extensions using molded-in compressible rings or locking rings riding in cut or molded grooves. The present embodiment of this invention does not preclude other coupling methods wherein winding arms are attached to a base using couplers that permit rotation of the winding arms on an axis which is perpendicular to the base.

Figure 4:
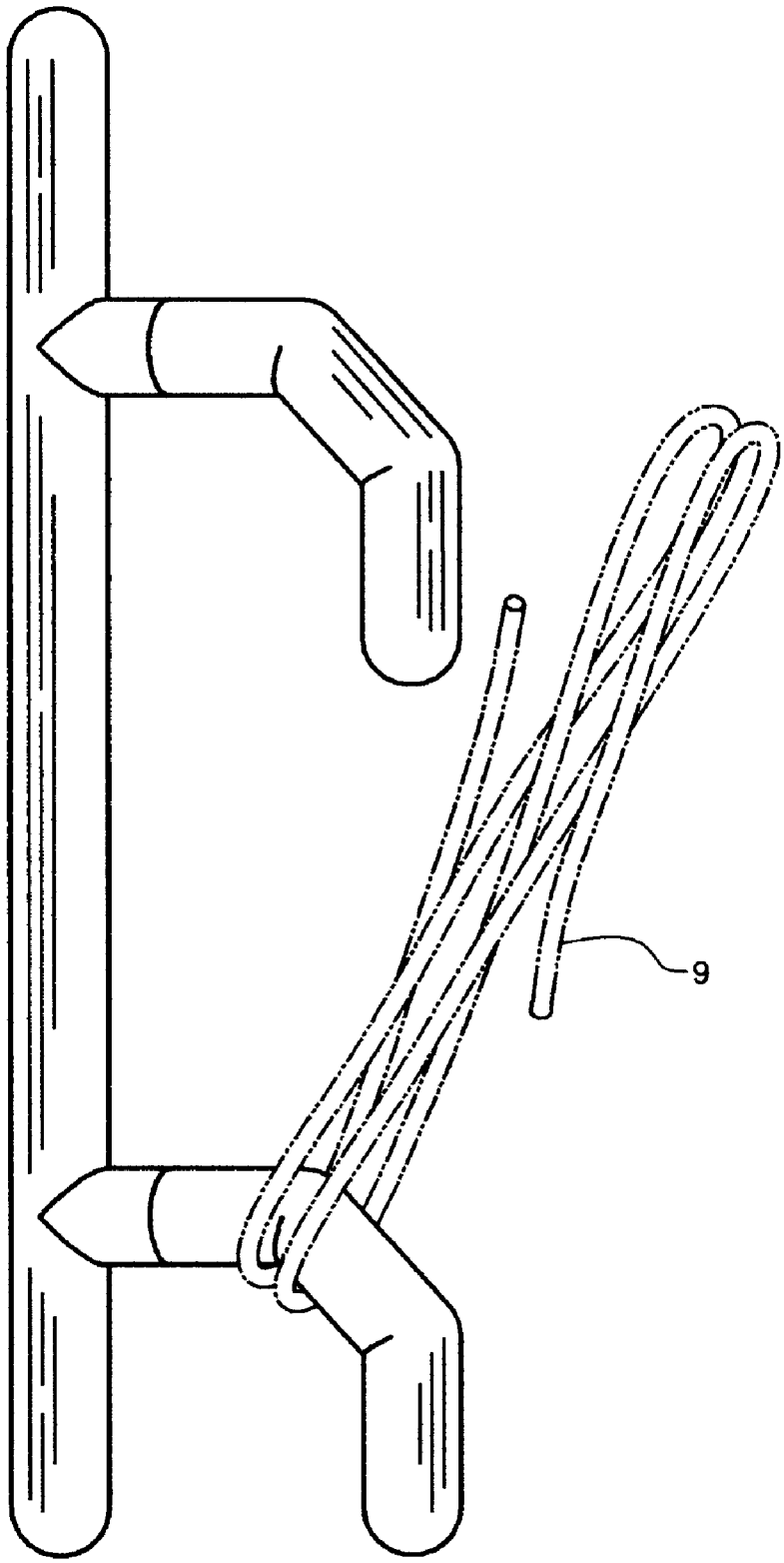
FIG. 4 is a perspective view of FIG. 1 showing the line holder in the open/fast-release position with line slipped and ready for tangle free release.

This line winding holder is in the open/fast-release position when one winding arm is rotated 180 degrees from the closed position to be parallel to the base while the second winding arm remains in the closed position as shown in FIG. 4. With one winding arm in the open/fast-release position line 9 is ready for tangle free deployment in single coils, multiple coils or dropped all-at-once as for tossing to a waterskier.

It should be evident that this disclosure is by way of example and while the invention is described in some detail, various changes may be made by adding, modifying or eliminating details without departing from the fair scope of the teaching contained in this disclosure except to the extent that the following claims are necessarily so limited.

What is claimed is:

1. A portable device for winding and storage of elongate materials, said device comprising: a hollow tubular base sealed at both ends and two hollow arcuate rotatable winding arms attached near the base ends with axes perpendicular to the base; a coupling assembly attaching each hollow arcuate rotatable winding arm to said hollow tubular base creating a U-shaped cavity for containing said elongate material wrapped between said arms; said coupling assembly having a silicon greased O-ring compressed in-between an extension groove of the base and a winding arm groove of the winding arm, wherein the extension groove of the base has a larger diameter than the winding arm groove of the winding arm, which slides with minimal resistance; the base and the arms are made of corrosion resistant and electrically non-conductive materials; a separation along the base between the winding arms permits unobstructed 360 degree rotation of both arms; and said device is floatable.

* * * * *